US006685501B1

(12) United States Patent
Wu et al.

(10) Patent No.: US 6,685,501 B1
(45) Date of Patent: Feb. 3, 2004

(54) CABLE CONNECTOR HAVING IMPROVED CROSS-TALK SUPPRESSING FEATURE

(75) Inventors: Jerry Wu, Irvine, CA (US); Yin-Tse Kao, La Mirada, CA (US); An-Jen Yang, Irvine, CA (US); Yuan-Chieh Lin, Lake Forest, CA (US); Jim Xin Zhao, Mission Viejo, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/264,650

(22) Filed: Oct. 3, 2002

(51) Int. Cl.[7] ..... H01R 12/24
(52) U.S. Cl. ..... 439/497; 439/493; 439/579
(58) Field of Search ..... 439/608, 493, 439/497, 579

(56) References Cited

U.S. PATENT DOCUMENTS 4,579,404 A * 4/1986 Lockard ..... 439/92
4,985,000 A * 1/1991 Tengler et al. ..... 439/497
6,273,749 B1 * 8/2001 Yang ..... 439/497
6,380,485 B1 * 4/2002 Beaman et al. ..... 174/88 R
6,394,839 B2 5/2002 Reed ..... 439/497
2003/0064625 A1 * 4/2003 Ozai ..... 439/579

* cited by examiner

*Primary Examiner*—Michael C. Zarroli
(74) *Attorney, Agent, or Firm*—Wei Te Chung

(57) ABSTRACT

A high speed cable connector (1) includes a cover (10), a base (80) and a cable assembly (30) mounted between the cover and the base. The cable assembly includes a cable (42) consisting of a plurality of lines (44). Each line has a signal pair (47, 48) and a ground conductor (492). The signal pair includes a pair of upper and lower signal conductors (472, 482). The ground conductors are soldered to shielding plates (50). The shielding plates are soldered to top and bottom faces of a rear end of a printed circuit board (PCB) (62). The upper and lower signal conductors of each signal pair are soldered to the top and bottom faces of the rear end of the PCB, respectively, and located between two neighboring shielding plates, whereby cross-talk and interference between two neighboring signal pairs can be effectively suppressed and reduced. The PCB has a front end electrically connecting with contacts (662) for electrically engaging with a complementary connector. The cable connector further has latches (88) for latching with the complementary connector, and a pull tab (82) for releasing the latching when the pull tab is pulled.

26 Claims, 7 Drawing Sheets

CABLE CONNECTOR HAVING IMPROVED CROSS-TALK SUPPRESSING FEATURE

CROSS-REFERENCE TO RELATED APPLICATION

This application is a co-pending application of U.S. Patent Application entitled ELECTRICAL CONNECTOR HAVING A LATCH MECHANISM, invented by Jerry Wu, filed on Aug. 12, 2002 with Ser. No. 10/217,636, and assigned to the same assignee of this application. The disclosure of the co-pending application is wholly incorporated herein by reference.

BACKGROUND OF THE INVENTION

1. Field of the Invention

The present invention relates to a cable connector, and particularly to a high speed cable connector for use in INFINIBAND™ application.

2. Description of Related Art

Following the popularity of the Internet, information access speed becomes an important issue. Although the information processing speed of a central process unit (CPU) of a data processing machine, i.e., a computer or a server, is increased enormously, information processing speed of I/O port devices of the machine is still relatively low, which results in that information still can not be accessed by the machine from the Internet with a speed as quickly as expected.

To solve this problem, an INFINIBAND ™ I/O port structure is proposed, which offers three levels of link performance—2.5 Gbits, 10 Gbits and 30 Gbits/sec. An electrical connector for use in such high speed application always confronts a problem of cross-talk. Cross-talk means interference of signals of neighboring signal lines.

U.S. Pat. No. 6,394,839 B2 (the '839 patent) disclosed a high speed cable connector which has two lines 12*a*, 12*b* each include a signal pair 20 and a ground conductor 18. The ground conductors 18 are connected to a shorting bar 50 which has a first portion 52 located between the signal pairs to improve the problem of cross-talk therebetween.

The structure disclosed by the '839 patent still cannot overcome the problem of cross-talk occurred in an electrical connector for INFINIBAND™ architecture since it must transmit and process information and data at an even higher speed.

Thus, an improved shielding structure which can effectively reduce cross-talk between signal pairs of a cable connector for InfiniBand™ application is required.

SUMMARY OF THE INVENTION

Accordingly, an object of the present invention is to provide a high speed cable connector wherein cross-talk between neighboring signal pairs at an end of a cable connecting with a connector can be effectively reduced and suppressed.

In order to achieve the object set forth, a high speed cable connector for INFINBAND™ application includes a cover and a base both made by die casting of aluminum alloy, and a cable assembly mounted between the cover and the base. The cable assembly includes a cable consisting of a plurality of lines. Each line has a pair of signal conductors and a ground conductor. The ground conductors are soldered to shielding plates which are in turn soldered to a rear end of a printed circuit board. Each signal pair includes an upper and a lower signal conductor which are soldered to top and bottom faces of the rear end of the printed circuit board, and located between two neighboring shielding plates. The shielding plates extend in a vertical direction which is perpendicular to a horizontal direction in which the printed circuit board extends. The printed circuit board has a front end fixed to a rear end of an insulative body which has a forwardly extending tongue. Contacts are received in top and bottom faces of the tongue. The contacts are used for electrically engaging with a complementary connector. The contacts each have a rear end soldering to the front end of the printed circuit board. A pair of latches is mounted on lateral sides of the base near a front end thereof. The latches are used for latching with the complementary connector when it mates with the cable connector in accordance with the present invention. The cable connector further comprises a pull tab movably mounted therein. When the pull tab is pulled rearwards, driving blocks formed on the pull tab push the latches laterally outwardly to causes the lathes to release their latching from the complementary connector.

Other objects, advantages and novel features of the invention will become more apparent from the following detailed description when taken in conjunction with the accompanying drawings.

DETAILED DESCRIPTION OF THE INVENTION

Figure 1:
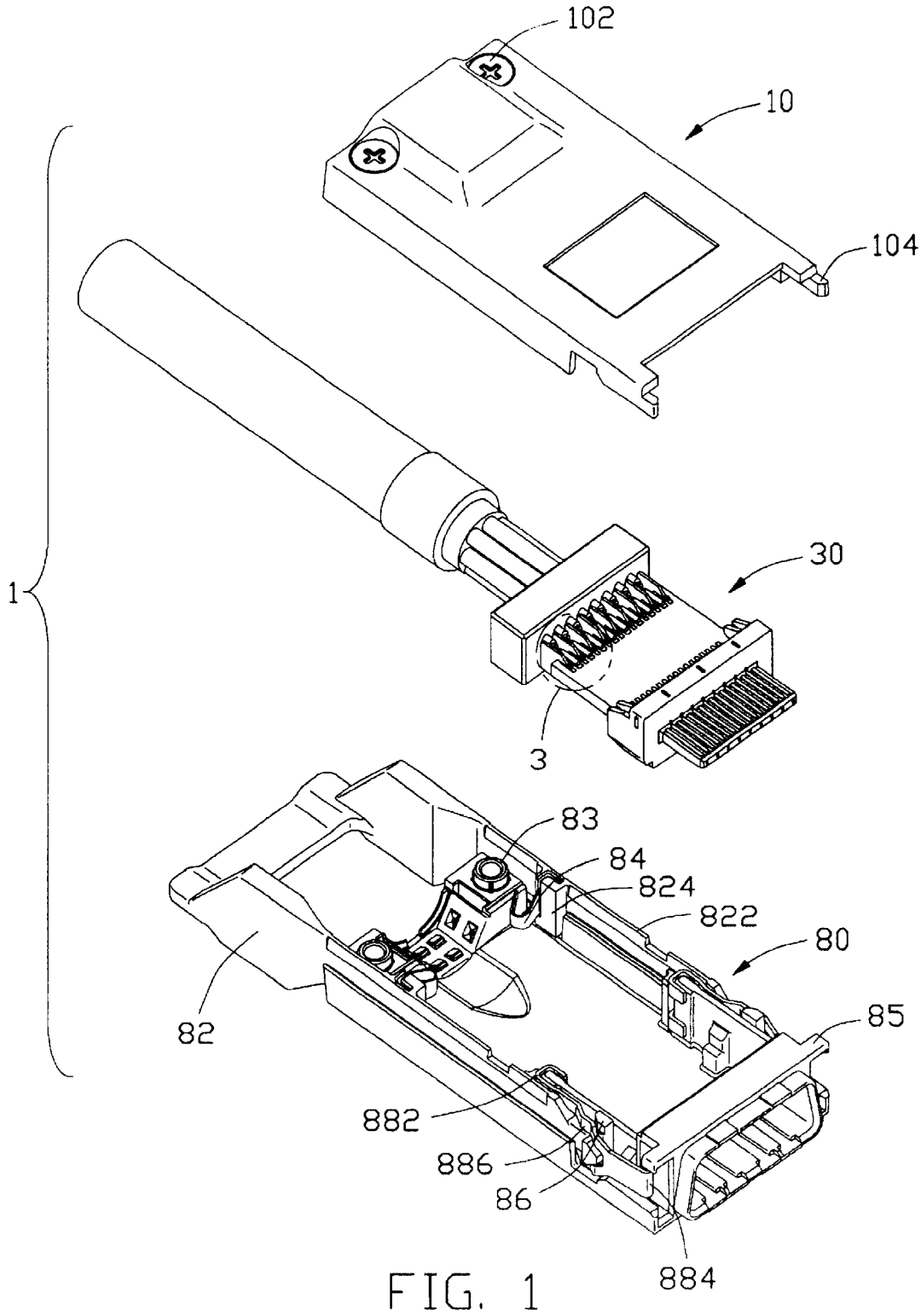
FIG. 1 is a perspective, exploded view of a cable connector for use in an InfiniBand™ application in accordance with the present invention.

Referring to FIG. 1, a cable connector 1 for use in an INFINIBAND™ application in accordance the present invention comprises a cover 10, a cable assembly 30 and a base 80. Both the cover 10 and base 80 are formed by die casting of metal such as aluminum alloy. The cover 10 is provided with screws 102 for screwing into screw holes (not labeled) defined in studs 83 formed in the base 80 after the cable assembly 30 is put in the base 80 to thereby assemble the cover 10, the cable assembly 30 and the base 80 together. To mount the cover 10 to the base 80, firstly protrusions 104 formed on a front end of the cover 10 are positioned below side flanges 85 formed on a front end of the base 80, respectively. Then a rear end of the cover 10 on which the screws 102 are located is pivoted downwardly about the flanges 85 toward the base 80 until the rear end of the cover 10 is in contact with a rear end of the base 80. The cable connector 1 is further provided with a pull tab 82 movably mounted between the cover 10 and base 80 for releasing a latch between the cable connector 1 and a complementary connector. Regarding this detailed illustrations are given below.

Figure 2:
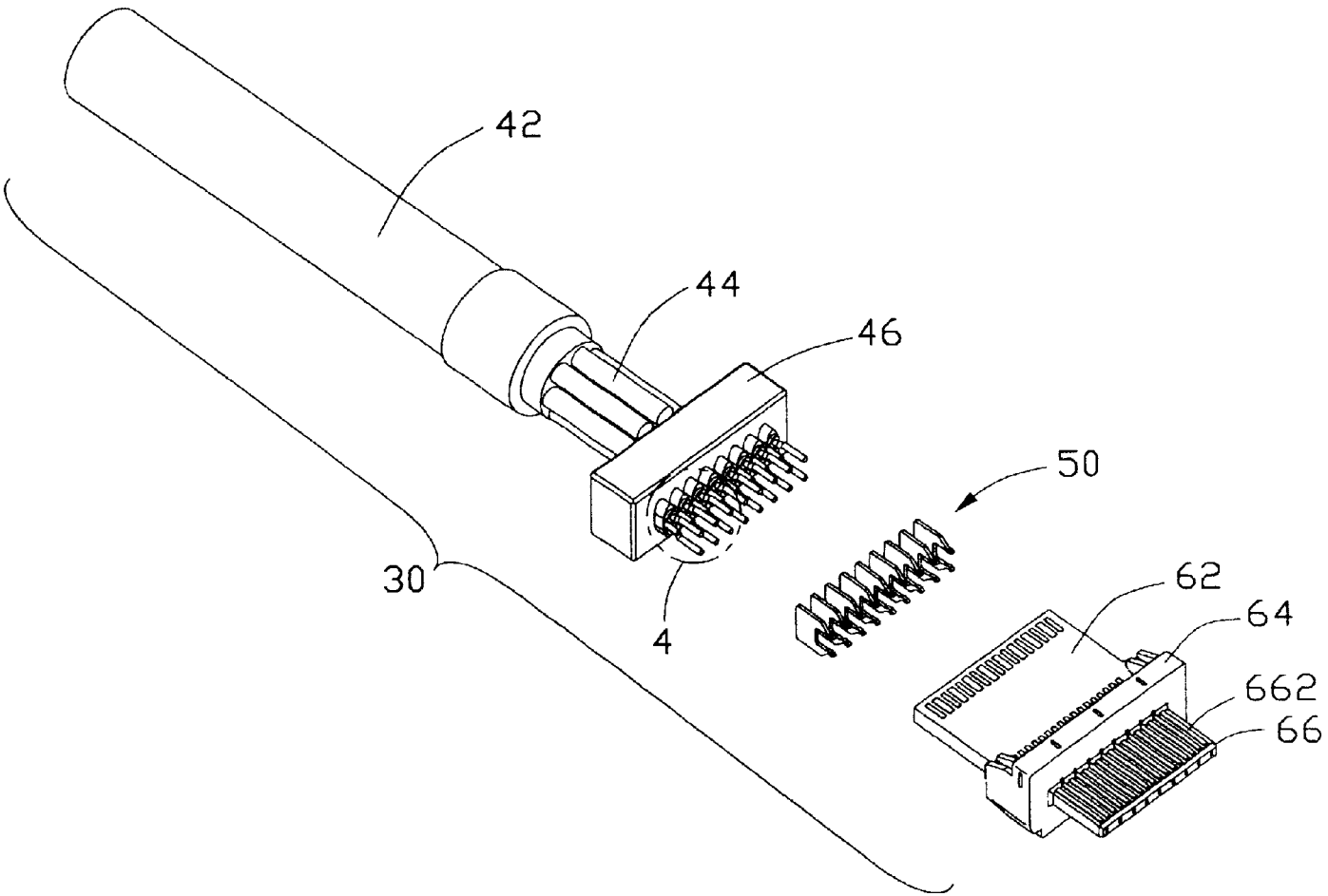
FIG. 2 is a perspective, exploded view of a cable assembly of the cable connector in accordance with the present invention.
Figure 3:
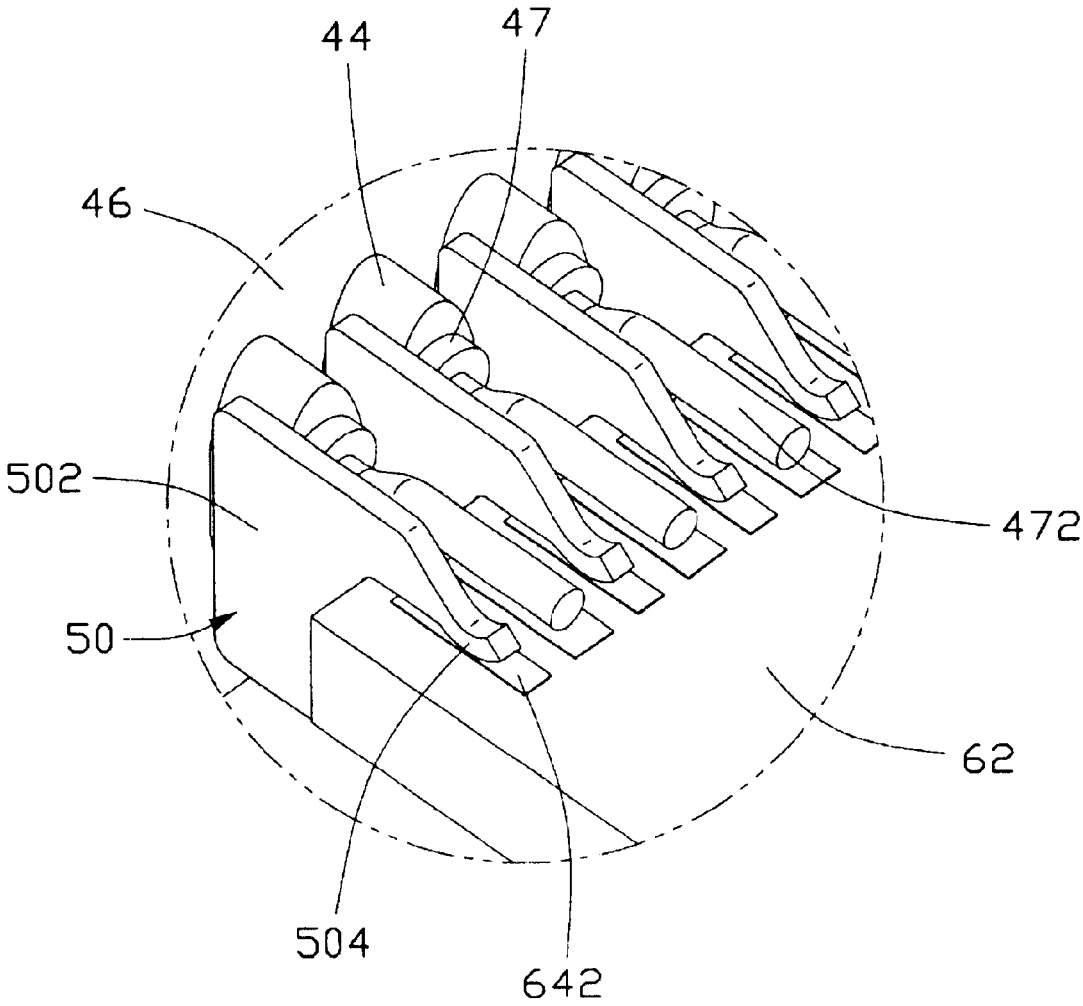
FIG. 3 is an enlarged view of a circled portion of FIG. 1 indicated by reference number 3 thereof.
Figure 4:
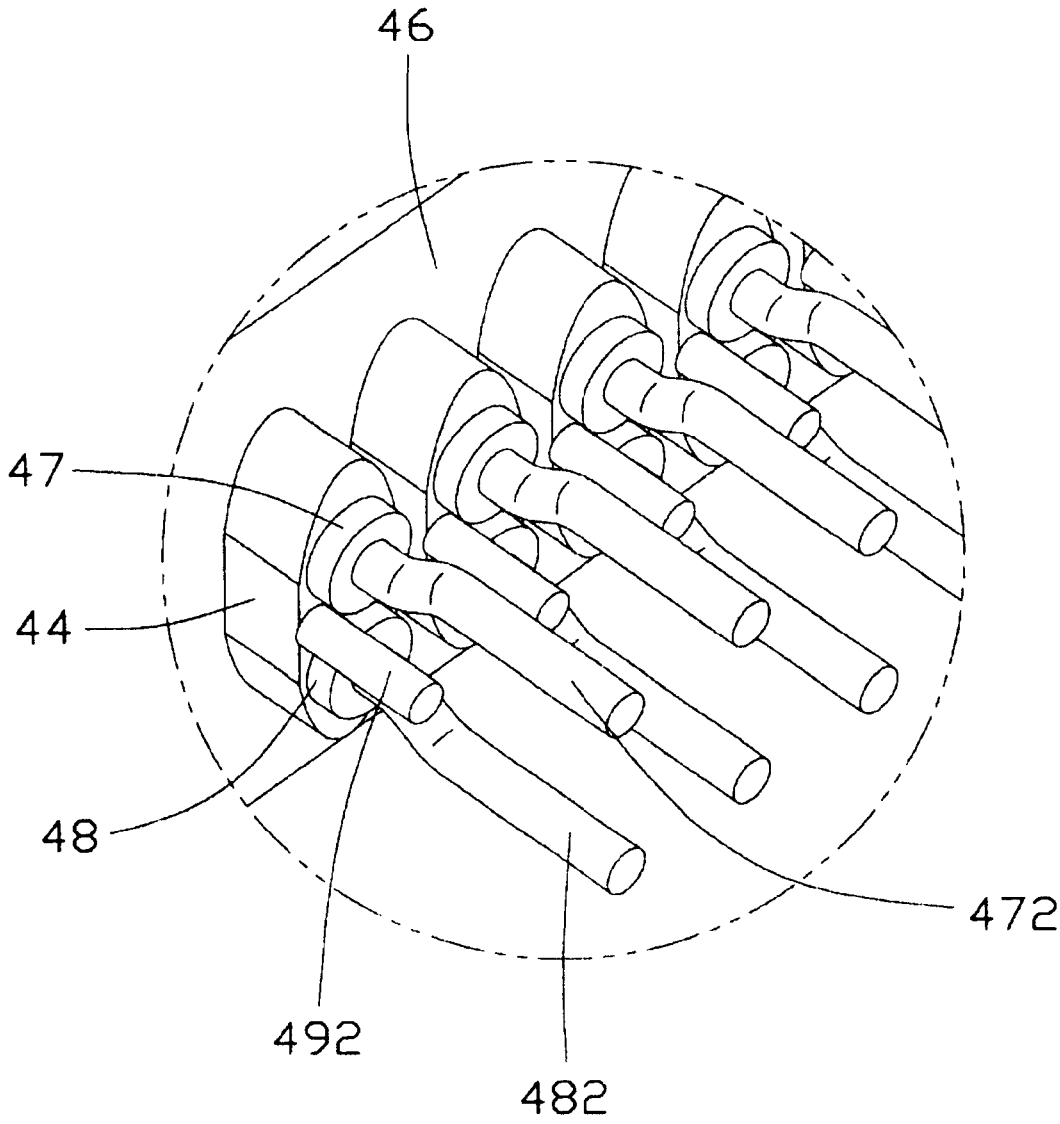
FIG. 4 is an enlarged view of a circled portion of FIG. 2 indicated by reference number 4 thereof.

Referring to FIG. 2, the cable assembly 30 includes a cable 42 accommodating eight lines 44 therein, a spacer 46 fixedly connecting front ends of the eight lines 44 in an equally spaced relationship, eight shielding plates 50, a printed circuit board (PCB) 62, an insulative body 64 having a rear end to which a front end of the PCB 62 is secured and a tongue 66 extending forwardly. The front ends of the lines 44 are arranged to laterally extend in the spacer 46. A plurality of contacts 662 is received in top and bottom faces (not labeled) of the tongue 66 for electrically connecting with the complementary connector. Each contact 662 has a rear end soldering to the front end of the PCB 62. The spacer 46 is insert molded to the front ends of the lines 44 to connect therewith, and has a cuboidal configuration.

Referring to FIGS. 3, 4, 7 and 9, each line 44 includes a signal pair 47, 48 and a ground conductor 492. The signal pair 47, 48 includes signal conductors 472, 482, respectively. Each shielding plate 50 includes a body portion 502 and bifurcated upper and lower fingers 504, 506. The fingers 504, 506 are curved toward each other. The signal conductors 472, 482 of the signal pair 47, 48 of each line 44 are so arranged that they are vertically aligned with each other. The ground conductor 492 of each line 44 is located between and at a left side of the signal pair 47, 48 thereof, as viewed from FIG. 4.

In assembling the cable assembly 30, the rear ends of the contacts 662 are soldered to solder pads 622 (FIG. 5) on the front end of the PCB 62. The ground conductors 492 are then soldered to the body portions 502 of the shielding plates 50, respectively. The shielding plates 50 and the signal conductors 472, 482 are soldered to solder pads 642 on a rear end of the PCB 62 in which the upper fingers 504 of the shielding plates 50 are soldered to the solder pads 642 on a top face of the PCB 62 while the lower fingers 506 are soldered to the solder pads 642 on a bottom face of the PCB 62. The shielding plates 50 are so located that a pair of vertically aligned solder pads 642 respectively on the top and bottom faces of the rear end of the PCB 62 is located between two neighboring shielding plates 50. The signal conductor 472 of each signal pair 47, 48 is soldered to a corresponding solder pad 642 on the top face of the PCB 62 between two corresponding neighboring shielding plates 50, and the signal conductor 482 is soldered to a corresponding solder pad 642 on the bottom face of the PCB 62 between the two corresponding neighboring shielding plates 50. The ground conductors 492 and the signal conductors 472, 482 are electrically connected to the contacts 662 via circuitry (not shown) of the PCB 62. The body portion 502 of each shielding plate 50 has a front edge tightly abutting against a rear edge of the PCB 62. The shielding plates 50 each have a length larger then a length of the signal conductors 472, 482 exposed to environment. Furthermore, the body portion 502 extends in a vertical direction which is perpendicular to a horizontal extension direction of the PCB 62, and has a height larger than a vertical distance between the signal conductors 472, 482 of a corresponding signal pair 47, 48. Moreover, the fingers 504, 506 extend on the PCB 62 a length which is substantially the same as that the signal conductors 472, 482. Thus, neighboring signal pairs are sufficiently shielded from each other by a corresponding shielding plate therebetween. Accordingly, interference and cross-talk between the neighboring signal pairs can be effectively suppressed and eliminated by the corresponding shielding plate therebetween.

Figure 5:
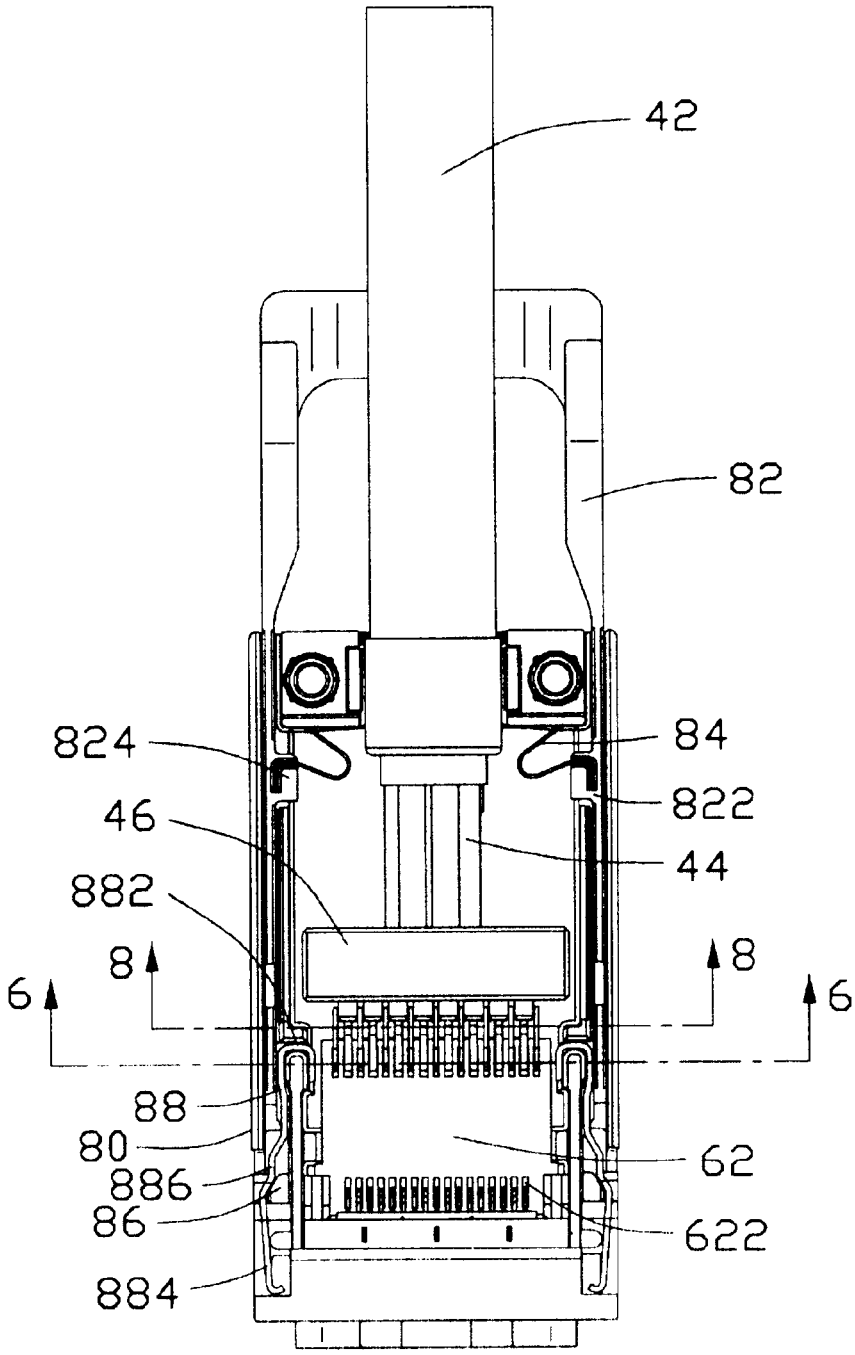
FIG. 5 is top view showing the cable assembly of FIG. 2 mounted in a base of the cable connector in accordance with the present invention.
Figure 6:
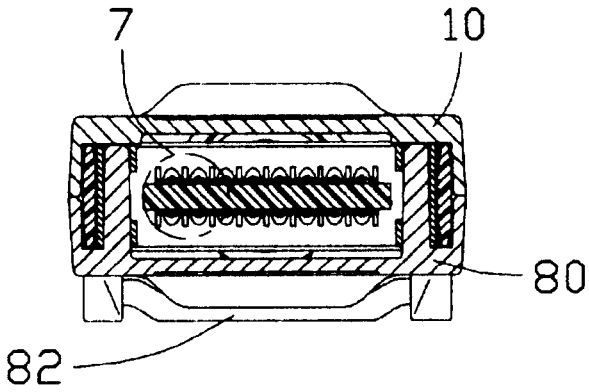
FIG. 6 is a cross-sectional view taken along line 6—6 of FIG. 5.
Figure 7:
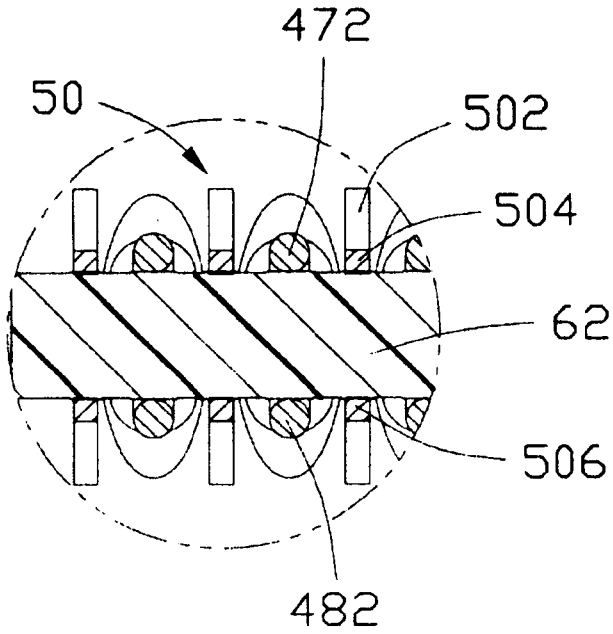
FIG. 7 is an enlarged view of a circled portion of FIG. 6 indicated by reference number 7 thereof.
Figure 8:
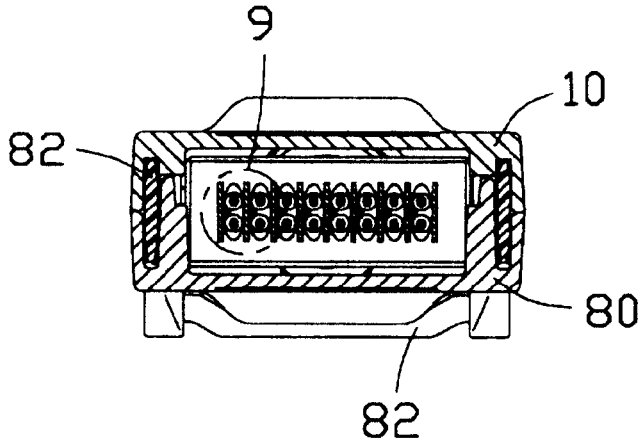
FIG. 8 is a cross-sectional view taken along line 8—8 of FIG. 5.
Figure 9:
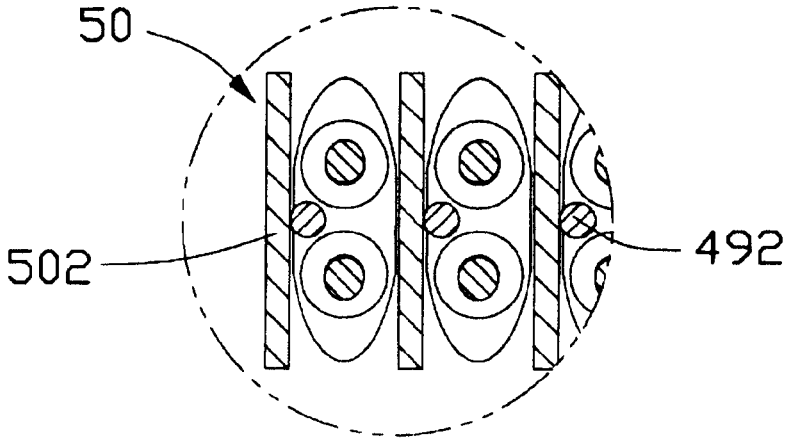
FIG. 9 is an enlarged view of a circled portion of FIG. 8 indicated by reference number 9 thereof.

Referring to FIG. 5 in cooperation with FIG. 1, the pull tab 82 has two arms 822 extending forwardly, each arm 822 forming a mounting block 824 at an inner side of a rear portion thereof and a driving block 86 at the inner side of a front end thereof. A pair of latches 88 is mounted on a front portion of lateral walls of the base 80. Each latch 88 has a hooked front end 884 for latching with the complementary connector when the cable connector 1 in accordance with the present invention mates with the complementary connector, a rear end 882 fixedly secured to the base 80, and a cam portion 886 formed between the hooked front end 884 and the rear end 882. The cam portion 886 has an inner face abutting against the driving block 86 of a corresponding arm 822 of the pull tab 82. The cam portion 886 has an inwardly, rearwards stepped configuration, whereby when the driving block 86 moves rearwards as the pull tab 82 is pulled rearwards, the driving block 86 causes the cam portion 886 and thus the hooked front end 884 to move laterally outwardly, thereby to release the latch between the cable connector 1 in accordance with the present invention and the complementary connector. A pair of leaf springs 84 is provided with the cable connector 1 wherein each spring 84 has a front end fixed in the mounting block 824 of a corresponding arm 822 of the pull tab 82, and a rear end fixed to the base 80. When the pull tab 82 is pulled rearwards, the springs 84 are compressed. When the pulling force is released, the springs 84 return to their original configurations, thereby motivating the pull tab 82 to return to is original position prior to being pulled. Thus, the latches 80 return to their original position as shown in FIG. 5. Concerning more detailed information of the structure, mounting and action of the pull tab 82, the leaf springs 84 and the latches 88, one can refer to the disclosure of the co-pending patent application mentioned in CROSS-REFERENCE TO RELATED APPLICATION of this specification.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

a base;

a cover fixed on the base; and a cable assembly mounted between the cover and the base, comprising:

a cable having a plurality of signal conductors and a plurality of ground conductors;

a printed circuit board; and a plurality of shielding plates separately and electrically connected to the printed circuit board and the ground conductors, respectively, an exposed portion of each signal conductor being connected to the printed circuit board and located between two neighboring shielding plates; wherein each of said shielding plates includes a body portion defining a main surface thereon, and an exposed portion of the corresponding ground conductor is soldered upon said body portion in a parallel relation; wherein a front end of an insulative layer enclosing each of said signal conductors, is spaced from a corresponding rear edge of the printed circuit board with a distance.

2. The cable connector in accordance with claim 1, wherein the cable assembly further comprises a plurality of contacts electrically connecting with the signal and the ground conductors via the printed circuit board.

3. The cable connector in accordance with claim 2, wherein the cable assembly further comprises an insulative body having a rear end to which the printed circuit board is fixed and a tongue extending forwardly, the contacts being received in top and bottom faces of the tongue.

4. The cable connector in accordance with claim 3, wherein each shielding plate has bifurcated upper and lower fingers extending forwardly from the body portion, the upper and lower fingers being soldered to top and bottom faces of the printed circuit board.

5. The cable connector in accordance with claim 4, wherein the body portion has a height larger than a vertical distance between the first and second signal conductors of the each of the signal pairs.

6. The cable connector in accordance with claim 5, wherein the cable assembly further comprises a spacer connected to front ends of the lines and equally spacing the front ends of the lines from each other.

7. The cable connector in accordance with claim 6, wherein the pair of the signal conductors of each line are soldered to the top face and the bottom face of the printed circuit board, respectively.

8. A cable connector comprising:

a base;

a cover mounted on the base; and a cable assembly mounted between the base and the cover, comprising:

a cable including a plurality of lines each including a ground conductor and a signal pair including upper and lower signal conductors;

a plurality of shielding plates each being in electrical connection with a corresponding ground conductor;

a printed circuit board having a front end and a rear end with which the shielding plates and the signal pairs are in electrical connection in such manner that each signal pair is located between two neighboring shielding plates, the upper signal conductors being in electrical connection with a top face of the printed circuit board and the lower signal conductors being in electrical connection with a bottom face of the printed circuit board; and a plurality of contacts each having a rear end in electrical connection with the front end of the printed circuit board and a front end adapted for electrically engaging with a complementary connector; wherein each of said shielding plates includes a body portion defining a main surface thereon, and an exposed portion of the corresponding ground conductor is soldered upon said body portion in a parallel relation; wherein a front end of an insulative layer enclosing each of said signal conductors, is spaced from the rear end of the printed circuit board with a distance.

9. The cable connector in accordance with claim 8, wherein the printed circuit board extends in a horizontal direction and the shielding plates each extend in a vertical direction.

10. The cable connector in accordance with claim 8 further comprising a pair of latches located at a front end of lateral walls of the base adapted for latching with the complementary connector, and a pull tab having a pair of driving blocks engaging with the latches, respectively, said driving blocks driving said latches to move in a direction for releasing their latch with the complementary connector when the pull tab is pulled rearwards.

11. The cable connector in accordance with claim 10 further comprising at least a resilient member which is deformed when the pull tab is pulled.

12. The cable connector in accordance with claim 11, wherein the printed circuit board extends in a horizontal direction and the shielding plates each extend in a vertical direction.

13. The cable connector in accordance with claim 12, wherein the base and the cover are made of metal.

14. A cable assembly for use in a cable connector comprising:

a cable comprising a plurality of lines each including a ground conductor and a signal pair including first and second signal conductors;

a plurality of shielding plates each being connected to a corresponding ground conductor;

a printed circuit board having opposite first and second ends, the shielding plates and the signal pairs being electrically connected to the first end of the printed circuit board in such manner that each of the signal pairs is located between two neighboring shielding plates; and a plurality of contacts being electrically connected to the second end of the printed circuit board and in electrical connection with the ground conductors and the signal conductors; wherein each of said shielding plates includes a body portion defining a main surface thereon, and an exposed portion of the corresponding ground conductor is soldered upon said body portion in a parallel relation; wherein a front end of an insulative layer enclosing each of said signal conductors, is spaced from the first end of the printed circuit board with a distance.

15. The cable assembly in accordance with claim 14, wherein the printed circuit board is extended in a first direction and the shielding plates each are extended in a second direction different from the first direction.

16. The cable assembly in accordance with claim 15, wherein the first direction is perpendicular to the second direction.

17. The cable assembly in accordance with claim 14, wherein each of the shielding plates has a body portion and bifurcated upper and lower fingers, the ground conductors being soldered to the body portions of the shielding plates, respectively, the upper fingers being soldered to a top face of the first end of the printed circuit board and the lower fingers being soldered to a bottom face of the first end of the printed circuit board.

18. The cable assembly in accordance with claim 17, wherein the body portions of the shielding plates abut against an edge of the first end of the printed circuit board.

19. The cable assembly in accordance with claim 14, wherein the first signal conductors are soldered to a top face of the first end of the printed circuit board and the second signal conductors are soldered to a bottom face of the first end of the printed circuit board.

20. The cable assembly in accordance with claim 19 further comprising an insulative body having a rear end to which the second end of the printed circuit board is securely fixed, and a forwardly extending tongue having top and bottom faces, the contacts being received in the top and bottom faces of the tongue.

21. The cable assembly in accordance with claim 20 further comprising a spacer connected to front ends of the lines of the cable, and equally spacing the front ends of the lines from each other.

22. The cable assembly in accordance with claim 21, wherein the spacer has a cuboidal configuration and the front ends of the lines in the spacer are so arranged that they are laterally extended.

23. A cable assembly for use in a cable connector comprising:

a cable comprising a plurality of lines each including a ground conductor and at least one signal conductor;

a spacer insert-molded to front ends of the lines and substantially equally spacing the front ends of the lines from each other;

a printed circuit board defining a rear end electrically connected to the signal conductors and said the ground conductors; and a plurality of shielding plates connected to the ground conductors, respectively, wherein each of the at least one signal conductor is located between two neighboring shielding plates; wherein said shielding plates are spaced from the spacer in a front-to-back direction with a first distance, and said spacer is spaced from the rear end of the printed circuit board with a second distance, said second distance being larger than the first distance.

24. The cable assembly in accordance with claim 23, wherein the at least one signal conductor includes an upper signal conductor and a lower signal conductor, and the ground conductor is located between and beside the upper and lower signal conductors.

25. A cable assembly for a cable connector, comprising:

a cable including a plurality of lines each including at least one signal conductor and a ground conductor; and a printed circuit board having top and bottom faces, wherein the at least one signal conductor of the each of said lines is electrically connected to a corresponding solder pad on least one of the top and the bottom faces of the printed circuit board, and the ground conductor thereof is electrically connected to the printed circuit board in such manner that the ground conductor of the each of said lines is located between the two corresponding signal conductors of the two neighboring lines; wherein said ground conductor is electrically connected to the printed circuit board via a corresponding shielding plate which is mechanically and electrically a corresponding solder pad of the printed circuit board, electrically and mechanically isolates the two corresponding neighboring signal pairs from each other, and electrically and mechanically connected to the said ground conductor; wherein each of said shielding plates includes a body portion defining a main surface thereon, and an exposed portion of the corresponding ground conductor is soldered upon said body portion in a parallel relation; wherein a front end of an insulative layer enclosing each of said signal conductors, is spaced from a corresponding edge of the printed circuit board with a distance.

26. The cable assembly in accordance with claim 25, wherein both the solder pad for the shielding plate and the solder pad for the signal conductor have a similar thickness.

* * * * *